US005121792A

United States Patent [19]

Schukey

[11] Patent Number: 5,121,792

[45] Date of Patent: Jun. 16, 1992

[54] COUNTERCURRENT HEAT-EXCHANGER

[75] Inventor: Jürgen Schukey, Hamburg, Fed. Rep. of Germany

[73] Assignee: SITA Maschinenbau- und Forschungs GmbH, Hamburg, Fed. Rep. of Germany

[21] Appl. No.: 499,382

[22] PCT Filed: Dec. 1, 1988

[86] PCT No.: PCT/EP88/01095

§ 371 Date: Jun. 6, 1990

§ 102(e) Date: Jun. 6, 1990

[87] PCT Pub. No.: WO89/05432

PCT Pub. Date: Jun. 15, 1989

[30] Foreign Application Priority Data

Dec. 10, 1987 [DE] Fed. Rep. of Germany ..... 3741869

[51] Int. Cl.[5] ..... F28F 3/04

[52] U.S. Cl. ..... 165/166; 165/167

[58] Field of Search ..... 165/165, 166, 167

[56] References Cited

U.S. PATENT DOCUMENTS

| | | | |
|---|---|---|---|
| 1,710,818 | 4/1929 | Fosbury | 165/167 |
| 2,429,508 | 10/1947 | Belaieff | 165/166 |
| 3,403,724 | 10/1968 | Gutkowski | 165/166 |
| 3,525,390 | 8/1970 | Rothman | 165/166 |
| 4,512,397 | 4/1985 | Stark | 165/166 |
| 4,556,105 | 12/1985 | Boner | 165/165 |
| 4,586,565 | 5/1986 | Hallström et al. | 165/167 |

FOREIGN PATENT DOCUMENTS

| | | | |
|---|---|---|---|
| 900326 | 6/1945 | France | 165/166 |
| 97491 | 6/1984 | Japan | 165/166 |

*Primary Examiner*—John Rivell
*Assistant Examiner*—L. R. Leo
*Attorney, Agent, or Firm*—Chilton, Alix & Van Kirk

[57] ABSTRACT

A counterflow plate-type heat exchanger has heat exchange areas which are arranged at an oblique angle relative to the stack direction. This arrangement enables channels to be formed having a smaller width for the passage of fluid than the distance between the plates in the stack direction. As a result, a high rate of heat exchange can be obtained. Corresponding inflow and outflow channels are arranged on opposite lateral sides of the stack. This provides for fluid flow through the stack from one side to the other in a manner such that the entire heat exchange area is contacted by fluid. The channels narrow in the inflow direction and widen in the outflow direction in order to provide optimum flow conditions in the exchanger.

20 Claims, 3 Drawing Sheets

COUNTERCURRENT HEAT-EXCHANGER

DESCRIPTION

The invention relates to a counterflow heat exchanger having exchange areas which are made of plates and are arranged between inflow channels narrowing in the inflow direction and outflow channels widening in the outflow direction.

In heat exchangers, even in counterflow heat exchangers, the problem occurs that heat exchange takes place only near the surfaces of a heat exchanger. Therefore heat exchange takes place only within a relatively small zone, namely inside the boundary-layer thickness. The medium which is thus cooled or heated then mixes with the medium which is not cooled or heated. Since this mixing action is irreversible, a significant deterioration in the efficiency takes place overall. On account of the conventional, relatively large distances between the heat-exchanger areas, the heat exchangers then also have a considerable size, which in turn leads to stability problems if the heat exchangers are to be used at high pressures.

A previously known heat exchanger in which the distances between the heat-exchanger areas are relatively small (U.S. Pat. No. 4,042,018) is manufactured from plates folded in a zigzag shape. This heat exchanger is of relatively complicated construction and has the disadvantage that the fluids do not sweep uniformly over the exchange areas but seek the shortest path (broken arrows on the left in FIG. 1 of the citation) so that no optimum heat exchange takes place.

The object of the invention is to create a heat exchanger of simple construction which is very effective.

The solution according to the invention consists in the panels being arranged in stacks of individual plates, in the exchange areas being arranged at an oblique angle relative to the stack direction, and in two adjacent plates each, on both sides of the stack, enclosing channels which alternately form on one side outflow channels and inflow channels and on the other side in each case the corresponding inflow channels and outflow channels.

Since the heat exchanger is manufactured from stacks of individual plates, it can be assembled from these individual plates in different form according to requirement. Since the exchange areas are arranged at an oblique angle relative to the stack direction, the channels here have a smaller width than corresponds to the distance between the plates in the stack direction. Better heat exchange is thereby obtained. Since the inflow and outflow channels are arranged on opposite sides of the stack, the fluids flow completely through the stack from one side to the other so that the entire heat-exchanger areas are swept over. Since the channels narrow in the inflow direction or widen in the outflow direction, optimum flow conditions are obtained. In the rear part of the channels, where only a little flow takes place, these channels can be smaller than in the front part where greater fluid quantities flow.

In order to obtain the same flow resistance overall, the inflow and outflow channels on one side expediently have a maximum cross-section which is equal to the flow cross-section of the channels between the exchange surfaces, the channels on the opposite side narrowing down to zero cross-section.

Manufacture is particularly efficient if the heat exchanger consists of plates which are identical but are assembled alternately with different orientation. Thus only one press for one type of plate needs to be manufactured, which plates are then assembled in such a way as to be alternately orientated relative to the heat exchanger.

In an advantageous embodiment, the channels between the exchange surfaces, viewed in the inflow or outflow direction, have a V-shaped cross-section. In this case, an inflow channel and the corresponding outflow channel face one another on opposite sides of the heat exchanger.

If the exchange surfaces are corrugated, the heat-exchanger area is increased on the one hand. If the corrugations still touch each other, the plates are mutually supported, as a result of which the overall size can likewise be reduced and thinner plates can be selected.

If the stacking of the sheet metal elements is not done in straight lines but is circular, a circular heat exchanger is obtained in which the feed and discharge of the media can be effected in a particularly simple manner by radial compressor.

The sheet metal elements can be welded, soldered, in particular brazed, to one another.

The heat exchanger is advantageously jacketed with a pressure-resistant and thermally-insulating insulating layer. If it is arranged in a pressure-tight and pressure-resistant housing, the interior space of which exhibits the pressure of the flowing media, the heat exchanger can be used even at very high pressures of these media. It merely has to be ensured by means of a small bore or the like that a little of one of the media under high pressure can pass from the heat exchanger into the pressure vessel, with the result that pressure compensation takes place here. The high operating pressures then no longer have to be withstood by the thin sheet metal elements but need now only be withstood by the pressure-resistant vessel.

The invention is explained below by means of advantageous embodiments with reference to the attached drawings, in which.

Figure 1:
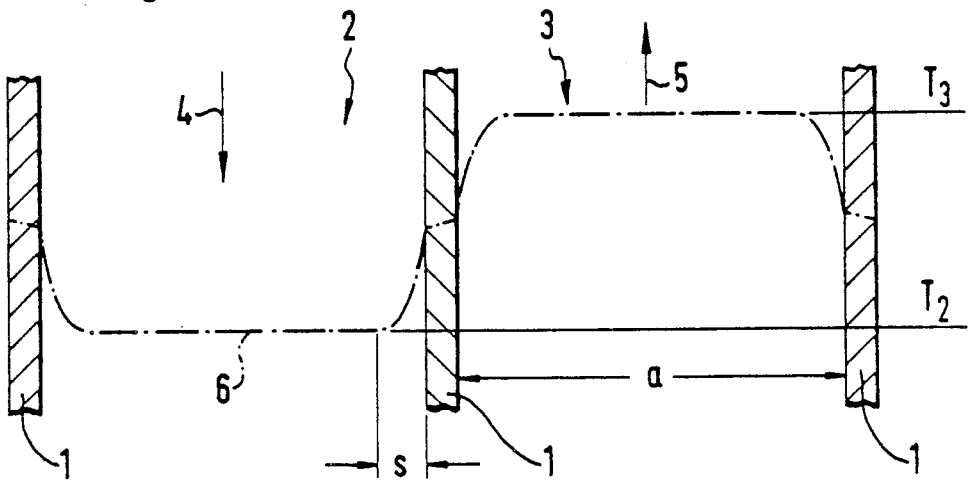
FIG. 1 shows, in cross-section, the principle of operation of a conventional heat exchanger.

FIG. 1 shows a conventional heat exchanger, between whose walls 1 two media 2 and 3 move in counter-current flow in the direction of the arrows 4 and 5. Medium 2 here has an original temperature $T_2$ and medium 3 has an original temperature $T_3$. The temperature progressions in the radial direction are indicated in the Figure by a curve 6. As can be seen, over the majority of the width a of the passages the temperature initially maintains the original value. A temperature exchange only occurs within the relatively small boundary layer of width s. Subsequently, the cooled or heated boundary regions must only then be mixed by the flow with the central regions of the flow, so that said regions participate only indirectly in the heat exchange, as a result of which the efficiency is lower.

Figure 2:
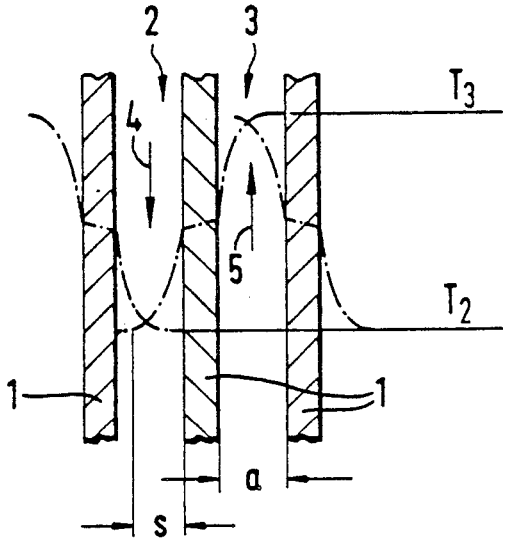
FIG. 2 shows in cross-section, the principle of operation of the heat exchanger according to the invention.

In the embodiment according to the invention and in accordance with FIG. 2, these problems no longer occur. All parts of the flowing media participate directly in the heat exchange since the width a of the flow passages is not substantially greater than the thickness S of the boundary layer.

Figure 3:
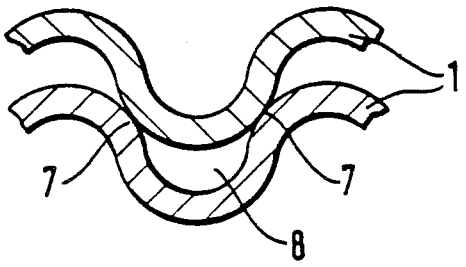
FIG. 3 shows a particular type of embodiment of the heat exchanger surfaces.

If, in accordance with FIG. 3, which shows the flow passages in plan view, not parallel walls 1 but walls 1 which have a corrugated shape are used, the heat exchange surface is thereby increased. Since the corrugations touch, for example at lines 7, the arrangement is very stable even where thin sheet metal elements are used. The flow passages 8 are thereby laterally delimited; a large flow passage is in this way divided into a plurality of smaller ones.

Figure 5:
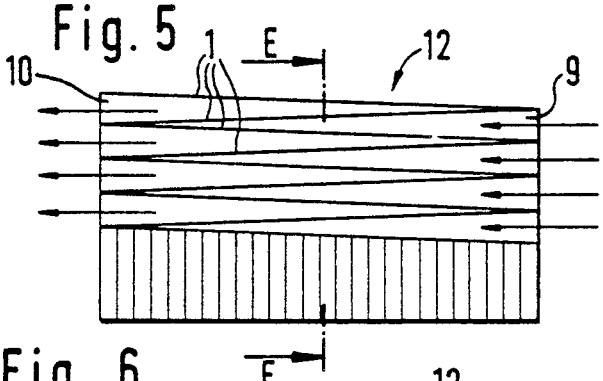
FIG. 5 shows the heat exchanger of FIG. 4 in cross-section along the line A—A.
Figure 4:
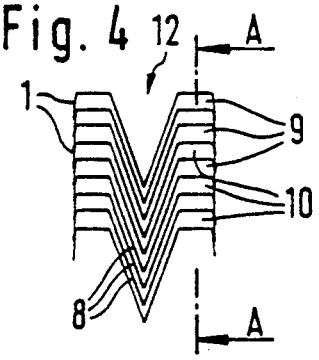
FIG. 4 shows an embodiment of the heat exchanger according to the invention, in cross-section along the line E—E in FIG. 5.
Figure 6:
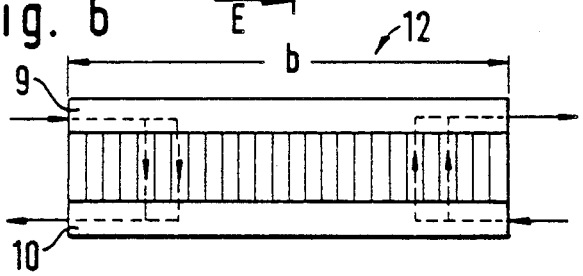
FIG. 6 shows the heat exchanger of FIGS. 4 and 5 in plan view.

In the embodiment of FIGS. 4 to 6, the heat exchanger consists of a stack of sheet metal elements 1 which are essentially V-shaped. In this arrangement, the limbs of the V lie relatively close together, with the result that the width of the flow passages 8 is here very small. At the ends of the limbs of the V there are angled-off sheet metal element regions which delimit the feed passages 9 and the discharge passages 10. In this arrangement, one feed passage 9 and one discharge passage 10 always alternate, one above the other in the section plane E—E, in the centre of the heat exchanger. Towards the sides, however, these passages narrow down to zero thickness, so that in the representation in FIG. 5 only feed passages are open from the right while towards the left only discharge passages 10 are open.

For this reason, one medium can be introduced on an end face at the end of one limb of the V and removed again on the same end face at the end of the other limb of the V. The like applies to the other medium. Here, the flow path is illustrated in plan view in FIG. 6.

Figure 8:
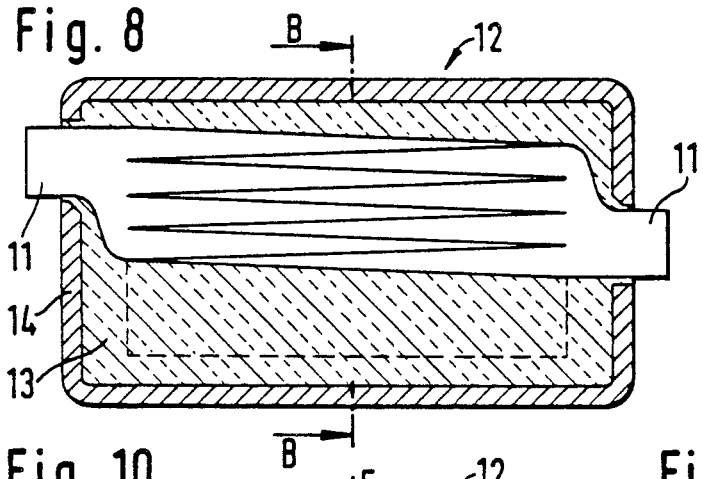
FIG. 8 shows the heat exchanger of FIG. 7 in section along the line C—C.
Figure 7:
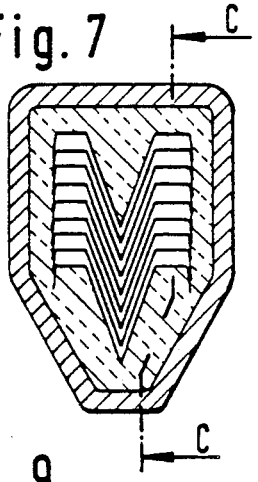
FIG. 7 shows, in a section along the line B—B in FIG. 8, the ready-to-operate heat exchanger.

FIGS. 7 and 8 show the heat exchanger of FIGS. 4 to 6, in which the individual passages 9 and 10 are in addition provided with connection pieces 11. The heat exchanger 12 itself is surrounded by a heat-resistant and pressure-resistant insulating mass 13, which is surrounded by a pressure-resistant housing 14. In this arrangement, the interior space of the pressure housing 14 is connected to the flowing media by pressure compensating bores, so that only a very slight pressure bears on the relatively thin sheet metal elements 1 of the heat exchanger 12 even in cases where both media have very high but approximately equal pressures.

Figure 10:
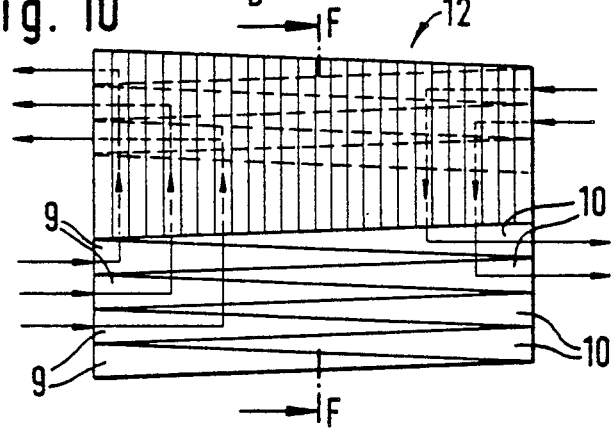
FIG. 10 shows the heat exchanger of FIG. 9 in section along the line D—D.
Figure 9:
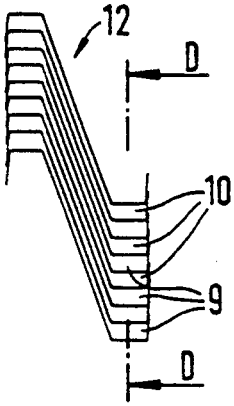
FIG. 9 shows another embodiment of the heat exchanger in section along the line F—F in FIG. 10.

In the embodiment of FIGS. 9 and 10, the actual heat exchanger surfaces are not angled off but are rectilinear. Apart from this, however, the conditions are otherwise essentially the same as in the embodiment of FIGS. 4 to 8, so that a detailed explanation can be omitted. Here too, feed passages 9 and discharge passages 10 alternate with one another in the cross-sectional area F and narrow towards the ends, so that one medium flows in or flows out in each case at one of the four ends.

Figure 11:
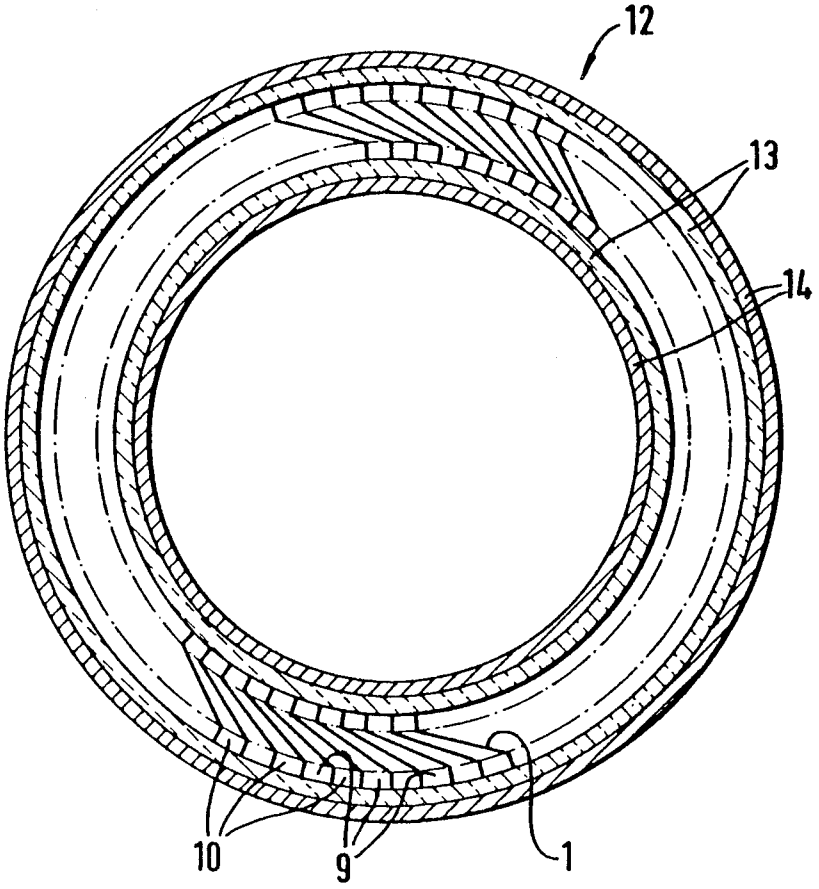
FIG. 11 shows a further embodiment of the heat exchanger in radial cross-section along the line G—G in FIG. 12.
Figure 12:
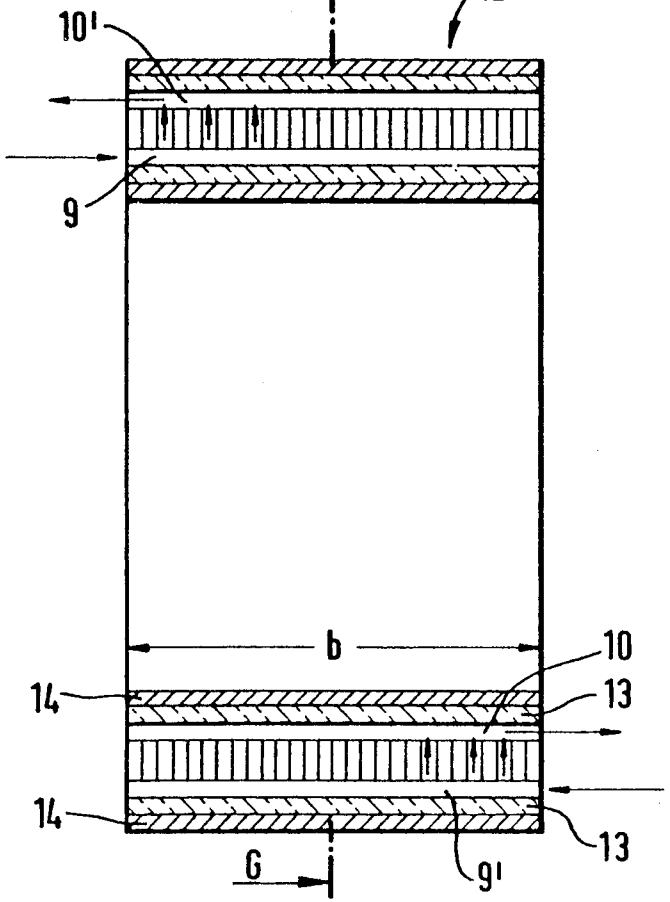
FIG. 12 shows a radial section of the heat exchanger of FIG. 10.

In the case of the heat exchanger of FIGS. 11 and 12, the sheet metal elements of the embodiment of FIGS. 9 and 10 are essentially used although they are no longer stacked rectilinearly one above the other but in the shape of a circle. This creates the flow conditions indicated in FIG. 12. One medium can be fed in from the left at the inner ring of feed passages 9 and removed again on the same side at the outer ring of discharge passages 10'. The other medium is introduced from the right at the outside through feed passages 9' and removed radially at the inside from the passages 10. In this embodiment, a radial compressor can very advantageously be used for conveying the media. In the case of the embodiment of FIGS. 11 and 12 too, a pressure-resistant insulation 13 and a pressure-resistant housing 14 are again provided.

At the end faces at which the media enter or leave, the sheet metal elements 1 of the heat exchangers are expediently welded or soldered to one another since here in each case one of the passages narrows to zero width and the corresponding sheet metal elements thus rest directly one on top of the other. In this way, a very stable basic structure is obtained, only the remaining end faces then having to be soldered together or closed up in some other way, this likewise being simple to effect, however, because of the corrugations.

I claim:

1. A counterflow heat exchanger having exchange areas which are made of plates (1) and are arranged between inflow channels (9, 9') narrowing in the inflow direction and outflow channels (10, 10') widening in the outflow direction, wherein the plates (1) are arranged in stacks of individual plates, wherein the plates have exchange surfaces arranged at an oblique angle relative to the stack direction, and wherein two adjacent plates (1) each, on both sides of the stack, enclose channels which alternatively form on one side outflow channels (10, 10') and inflow channels (9, 9') and on the other side in each case the corresponding inflow channels (9,9') and outflow channels (10,10').

2. The heat exchanger as claimed in claim 1, wherein the inflow and outflow channels (9, 9', 10, 10') on one side have a maximum cross-section which is equal to the flow cross-section of the channels (8) between the exchange surfaces and, on the opposite side, narrow down to zero cross-section.

3. The heat exchanger as claimed in claim 2, wherein the heat exchanger consists of plates (1) which are identical but are assembled alternately with different orientation.

4. The heat exchanger as claimed in claim 1, wherein the channels between the exchange surfaces, viewed in the inflow or outflow direction, have a V-shaped cross-section.

5. The heat exchanger as claimed in claim 1, wherein the exchange surfaces are corrugated.

6. The heat exchanger as claimed in claim 1, wherein the stacking is circular.

7. The heat exchanger as claimed in claim 1, wherein the plates (1) are welded to one another.

8. The heat exchanger as claimed in claim 1, wherein the plates (1) are brazed to one another.

9. The heat exchanger as claimed in claim 1, wherein the heat exchanger is covered with a pressure-resistant and heat-insulating layer.

10. The heat exchanger as claimed in claim 1, wherein the heat exchanger is arranged in a pressure-tight and pressure-resistant housing (14).

11. A counterflow heat exchanger comprising:

a plurality of individual plates, each plate having a central area defining a heat exchange surface and first and second areas extending laterally from respective sides of the heat exchange surface, wherein the plates are stacked to form a series of adjacent pairs in a stacking direction such that the first areas of adjacent plates form a first set of flow distribution passages, the second areas of adjacent plates form a second set of flow distribution passages, and the central areas of adjacent plates are oriented at an oblique angle with respect to the stacking direction and form heat exchange flow passages between the first and second flow distribution passages;

inlet means for directing an inlet flow of fluid to the stack;

outlet means for directing an outlet flow of fluid away from the stack;

wherein when viewed along the stacking direction, the first set of flow distribution passages form alternating feed and discharge passages which are fluidly connected with the inlet means and outlet means, respectively, and the second set of flow distribution passages form alternating discharge and feed passages which are fluidly connected with the outlet means and inlet means respectively, such that for a given adjacent pair, fluid flows from a feed passage, through the heat exchange passage and into a discharge passage, and wherein the feed passages narrow in the direction from the inlet means into the stack and the discharge passages widen in the direction from the stack toward the outlet means.

12. The heat exchanger as claimed in claim 11, wherein the heat exchanger has opposite first and second ends, and the alternating feed and discharge passages on each lateral side of the heat exchange surface have a cross-section at one end which is equal to the maximum flow cross-section between the exchange surfaces and narrow down to zero cross-section at the opposite end.

13. The heat exchanger as claimed in claim 12, wherein the heat exchanger consists of plates which are substantially identically formed but are assembled alternately with different orientation.

14. The heat exchanger as claimed in claim 11, wherein the exchange surfaces form flow passages which, when viewed in the inflow or outflow direction, have a V-shaped cross-section.

15. The heat exchanger as claimed in claim 11, wherein the exchange surfaces are corrugated.

16. The heat exchanger as claimed in claim 11, wherein the stacking is circular.

17. The heat exchanger as claimed in claim 11, wherein the plates are welded to one another.

18. The heat exchanger as claimed in claim 11, wherein the plates are brazed to one another.

19. The heat exchanger as claimed in claim 11, wherein the heat exchanger is covered with a pressure-resistant and heat-insulating layer.

20. The heat exchanger as claimed in claim 11, wherein the heat exchanger is arranged in a pressure-tight and pressure-resistant housing.

* * * * *